US007553268B2

(12) United States Patent
Ziliani

(10) Patent No.: US 7,553,268 B2
(45) Date of Patent: Jun. 30, 2009

(54) TOOL HOLDING CLAMP FOR RADIAL PRESSES

(75) Inventor: Massimo Ziliani, Brescia (IT)

(73) Assignee: OP S.r.l., Brescia (IT)

( * ) Notice: Subject to any disclaimer, the term of this patent is extended or adjusted under 35 U.S.C. 154(b) by 393 days.

(21) Appl. No.: 10/549,035

(22) PCT Filed: Mar. 5, 2004

(86) PCT No.: PCT/IT2004/000114

§ 371 (c)(1),
(2), (4) Date: Oct. 13, 2005

(87) PCT Pub. No.: WO2004/087349

PCT Pub. Date: Oct. 14, 2004

(65) Prior Publication Data

US 2006/0137503 A1 Jun. 29, 2006

(30) Foreign Application Priority Data

Apr. 4, 2003 (IT) ..... BS2003A0034

(51) Int. Cl.
*B23Q 3/155* (2006.01)
*B21J 7/16* (2006.01)
*B23P 19/04* (2006.01)
*B23B 7/04* (2006.01)

(52) U.S. Cl. ..... 483/29; 72/402; 29/237; 100/232

(58) Field of Classification Search ..... 483/16, 483/29; 29/235, 237, 280, 282, 243.56, 517; 72/402, 367.1, 452.1, 452.6, 452.7, 453.03, 72/453.15; 100/232, 214, 291; 425/330, 425/DIG. 5, DIG. 129
See application file for complete search history.

(56) References Cited

U.S. PATENT DOCUMENTS 4,306,442 A * 12/1981 Schrock ..... 72/402
4,766,808 A * 8/1988 Schrock ..... 100/232
7,043,806 B2 * 5/2006 Schrock et al. ..... 29/237

FOREIGN PATENT DOCUMENTS

DE 4446504 C1 * 3/1996
DE 19814474 7/1999
DE 20017791 12/2000
DE 19940744 A1 * 3/2001
EP 771615 A1 * 5/1997
EP 1106276 6/2001

* cited by examiner

*Primary Examiner*—Dana Ross
(74) *Attorney, Agent, or Firm*—Shoemaker and Mattare

(57) ABSTRACT

The present invention relates to a tool holding clamp for a multiple change of tools for radial presses, where said presses comprise a plurality of radial jaws (12, 12') onto which the tools (14) are mounted and where tools and jaws are provided with complementary coupling means, such as radial pins (15) and relative slots (16). The clamp presents centering devices, working together with the radial press to guarantee alignment of said complementary devices when the tools are mounted onto the jaws of the press. A tool holding rack for radial presses also constitutes the object of the invention, and is provided with devices adapted to interacting with the tool holding clamp for positioning the tools onto said clamp in the position of alignment with the jaws of the press.

13 Claims, 8 Drawing Sheets

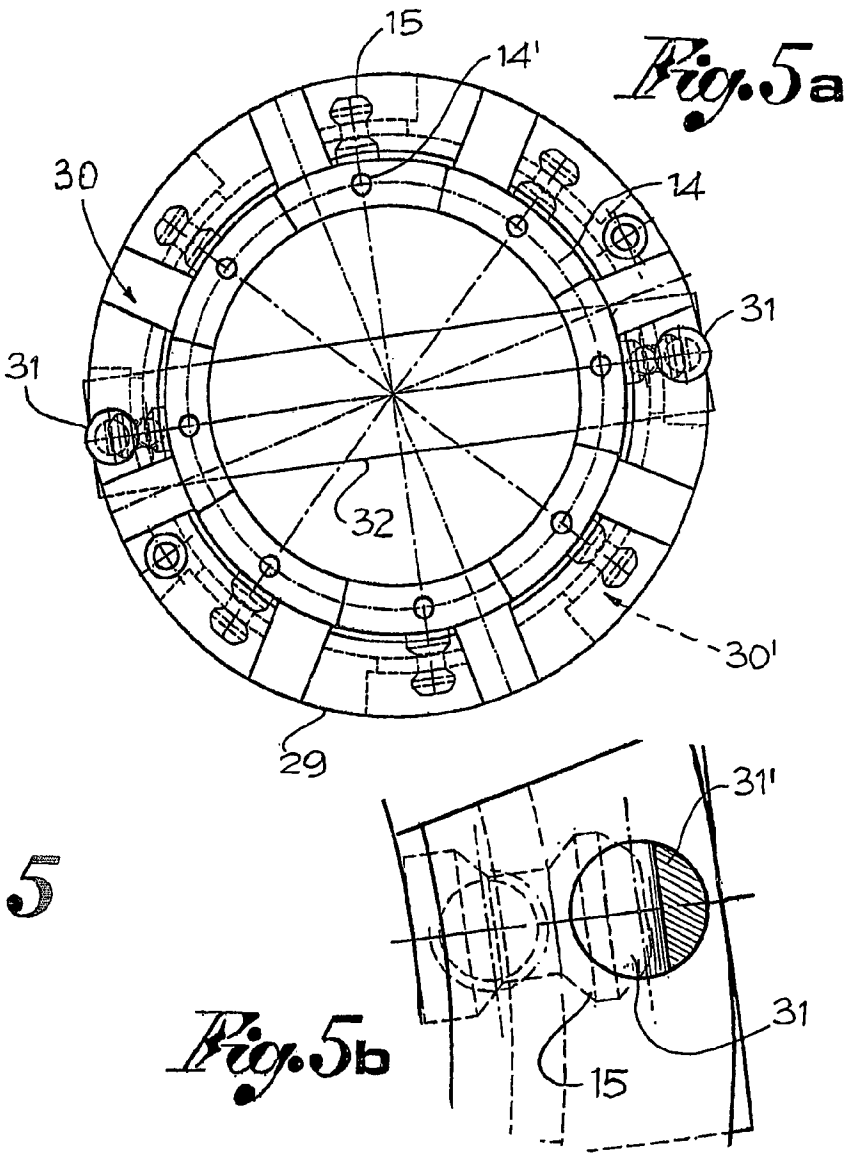
Fig. 5a
Fig. 5b
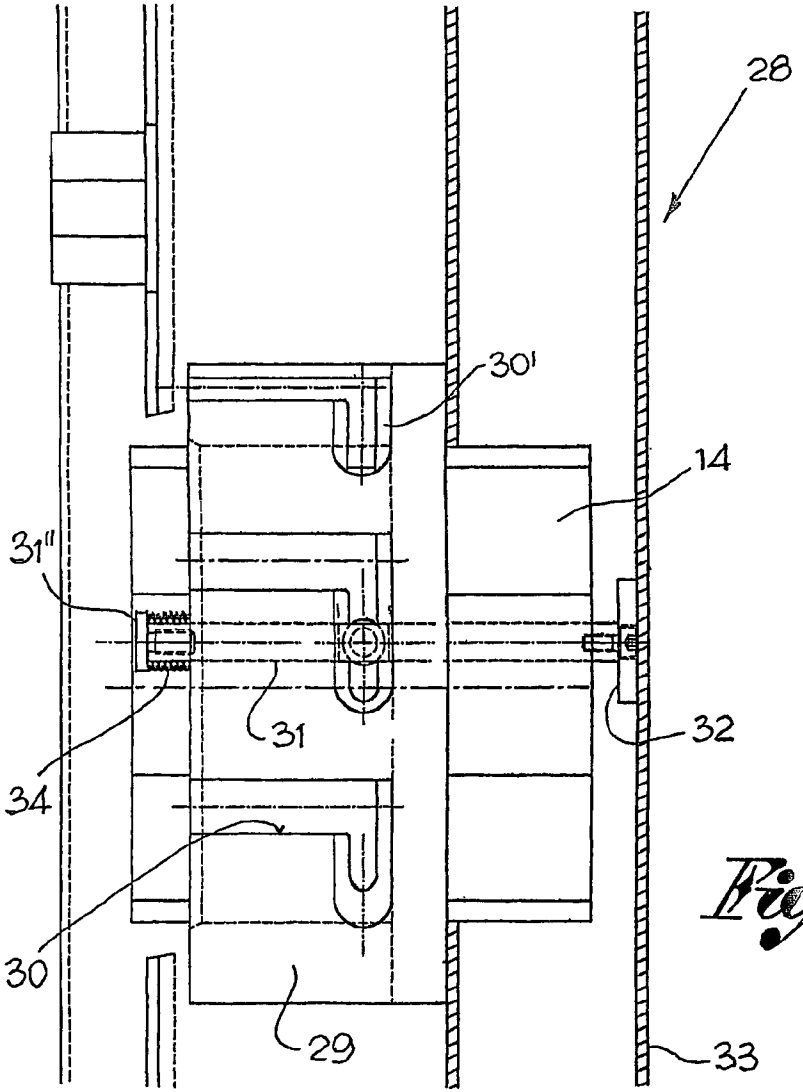
Fig. 5

TOOL HOLDING CLAMP FOR RADIAL PRESSES

FIELD OF THE INVENTION

The present invention relates to both horizontal and vertical type radial presses, for example for connecting flexible tubes, and refers, in particular, to a tool holding clamp supplied with devices for centering the tools on these presses.

The invention also relates to a new tool holding rack for vertical radial presses configured to assist the improved clamp in question.

BACKGROUND OF THE INVENTION

As is known, in order to be able to perform the pressing of parts with various diameters, radial presses are supplied with an equal number of sets of interchangeable tools, which are essentially made up of circle sector section blocks, to be applied to respective radial jaws on the press. To assist and speed up operations of tool changing, a tool holding clamp is used, which is configured to take all of the tools at the same time from a tool holding rack, which are suitable for pressing a tube with a specific diameter; these are mounted onto-the press in just one operation and, inversely, dismounted from the press just as quickly, and placed back in the rack at the same time.

For this purpose, each tool is fitted with a radial pin to be inserted and locked in a respective slot provided in the radial jaws, once the clamp has been placed in the central opening of the machine, when these jaws are commanded to close on it.

At present, however, the positioning of the pressing tool pins level with the slots in the jaws is performed without the aid of any centering system, and consequently requires great care by the operator, so that when closing, the jaws do not cause the pins to break. This is a particular inconvenience in the case of vertical presses, which also require angular alignment of the tools in relation to the jaws, as for the horizontal presses, besides axial alignment. In fact, in this type of press, the tools, which have different lengths depending on the diameter of the flexible tube to be pressed, must nonetheless always be in the center of the press, and so it is not possible to perform axial centering simply by resting the tool holding clamp against the front surface of the press.

OBJECTS OF THE INVENTION

The object of the present invention is to remedy this inconvenience by proposing a tool holding clamp for radial presses as described below.

Another object of the invention is to resolve the problem of centering the tools on the respective jaws in the case of vertical radial presses, by proposing a clamp and a tool holding rack that are configured to interact as described further below.

BRIEF DESCRIPTION OF THE DRAWINGS

Further details of the invention will, in any case, become clearer from the following description referring to the attached drawings, which are exemplary and not limiting, wherein:

FIGS. 5 and 5*a* show views similar to the previous ones, but with the shell in the tool unlocking position;

FIG. 5*b* shows a transverse section of an enlarged detail of FIG. 5*a;*

DETAILED DESCRIPTION OF THE INVENTION

Figures 1, 2, 3:
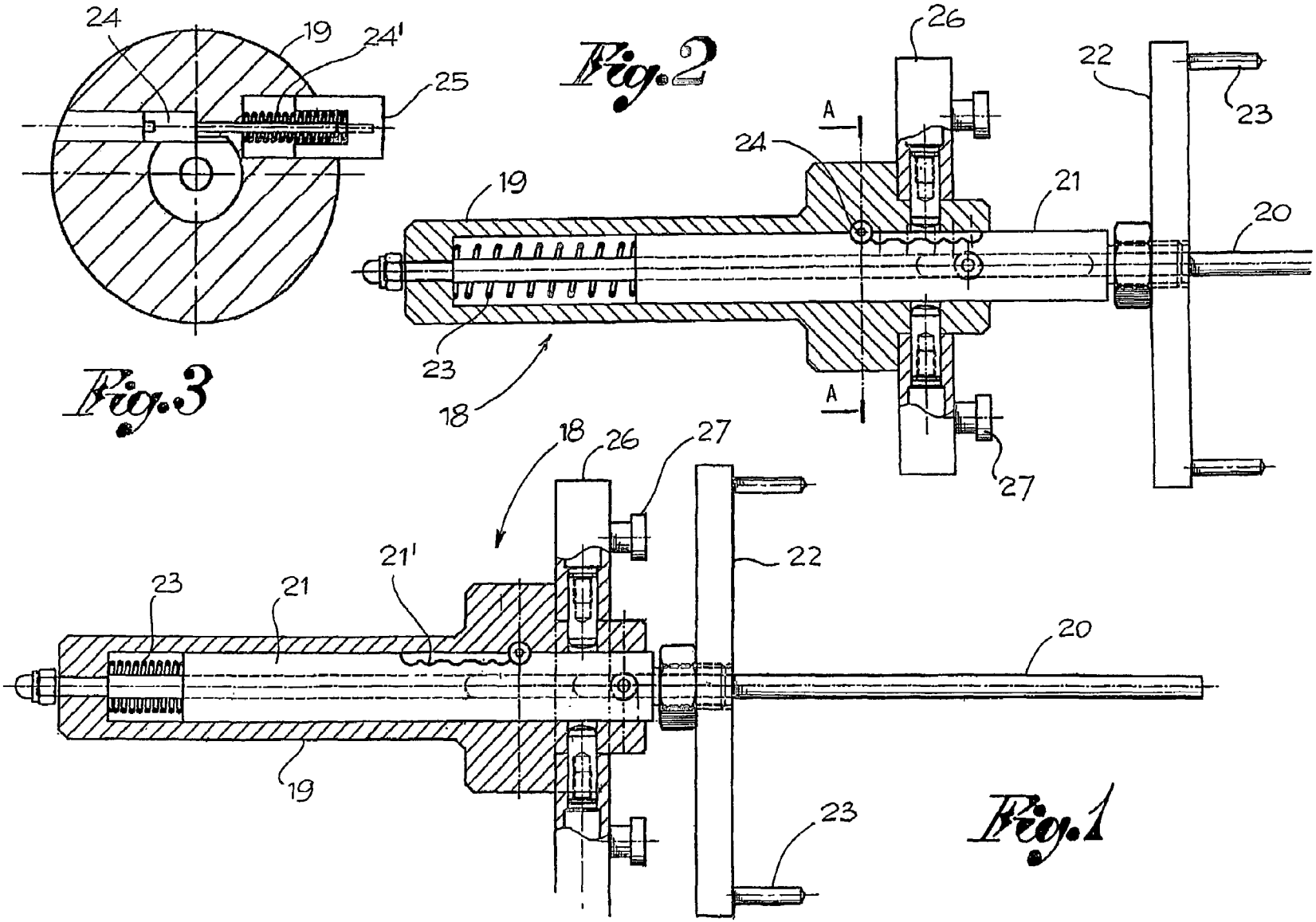
FIGS. 1 and 2 show an axial section of a tool holding clamp according to the invention for vertical radial presses, with the magnet holder disc in a backward and forward position respectively.
FIG. 3 shows a transverse section of the clamp along line A-A in FIG. 1.

In the drawings, two vertical and horizontal presses 10, 11 are shown fully, provided with a plurality of radial jaws 12, 12', respectively, marking a central opening 13 intended to receive the end of a piece of flexible tube to be connected. The jaws 12, 12' can be moved between an open, inactive position and a closed position for pressing a connection onto the tube. In the case of vertical radial presses 10, the closing/opening of the jaws 12 on the tube is carried out by a vertical movement, approaching/removing one block 10' on the press in relation to another, whereas in the case of horizontal radial presses 11 the closing/opening of the jaws 12' is controlled by a horizontally moveable piston 11'. The structure and working of these presses are, in any case, known and need no particular description herein.

In any case, a pressing tool 14 is to be mounted onto each jaw, which is basically constituted of a circle sector section block. In order for these to be coupled, the pressing tools 14 and the jaws 12, 12' are provided with a radial pin 15 and a corresponding slot 16 respectively suitable for receiving said pin. A lock pin 17 is also inserted into each jaw perpendicularly to the slot 16, which, stressed by a back spring 17', tends to constrain the tool pin 15 to the jaw when it is fully inserted into the slot 16.

For the purpose of mounting/dismounting all of the pressing tools 14 at the same time onto/from the respective jaws 12, 12', tool holding clamps are provided, which are adapted to take the tools from a rack, move them and place them in the central opening 13 on the press, and vice versa, always keeping them in a circular position. In this way, when the clamp is inserted into the center of the press, the tools 14 are already in position to be hooked by the relative jaws when they are commanded to close.

In the case of vertical radial presses 10, and with reference to FIGS. 1-8, the present invention proposes a tool holding clamp 18 and a tool holding rack 28 configured to guarantee angular and axial centering of the pressing tools 14 on the jaws 12 of these presses.

The tool holding clamp 18 has a grip handle 19 from which a fixed pin 20 comes out axially. A sliding pin 21 is placed around the fixed pin 20, and a normal disc 22 is fixed with a ring of magnets on its distal end protruding from the handle 19; the tools 14 are attached to these magnets with the aid of a ring of pins 23, extending from this disc to be inserted into corresponding holes 14' made in the tools 14. The sliding pin 21 with the magnet holder disc 22 is able to translate axially along the fixed pin 20 between two extreme positions, backwards, in which it finds itself completely contained in the handle 19, and forwards, passing through a plurality of intermediate positions. The sliding pin 21 is pushed towards the forward position by a spring 23 located inside the handle 19 and can be stopped in the backward position and in each of the intermediate positions using the locking devices with which the manually operable clamp is fitted. In the form of embodiment described in FIGS. 1-3, the sliding pin 21 has a plurality of transverse grooves 21' in each of which, selectively, it engages a small stop cylinder 24 set transversely in the handle 19 and stressed by a spring 24'. A button 25 is connected to the small cylinder 24 which releases it from the grooves 21' when it is pressed, allowing the sliding pin 21 to slide onto the fixed one 20.

A plate for angular centering 26 is also fixed on the distal end of the clamp handle 19; this plate is fitted, at the top, with a pair of mushroom pins 27 and, at the bottom, with a pair of pins 35. This plate 26 is intended to rest on the front part of the press 10, which will be described in further detail later on.

Figure 4A:
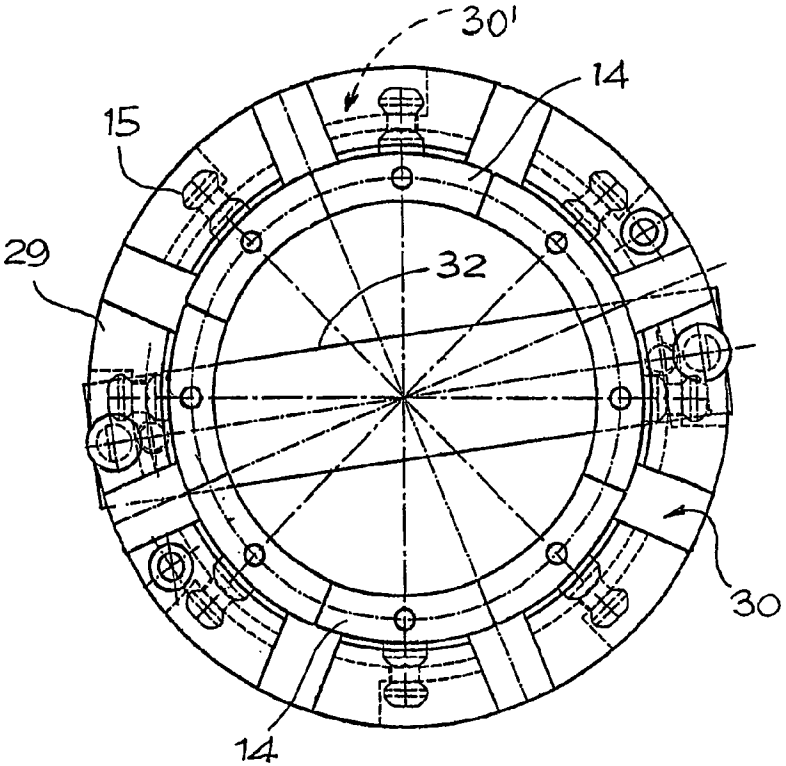
FIGS. 4 and 4*a* show a side and front view of one of the tool holding shells of a tool holding rack according to the invention for vertical radial presses, in the tool locking position.
Figure 4:
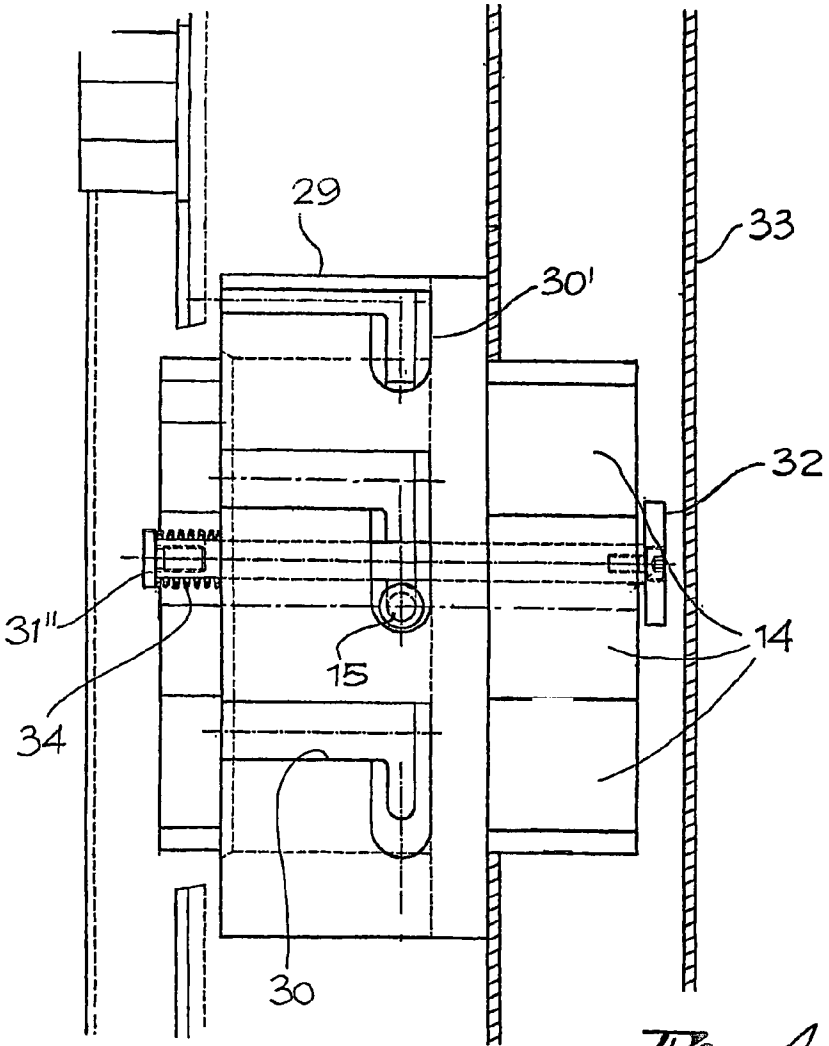

A plurality of tool holding shells 29 is located in the tool holding rack 28, one for each sized tool 14. Each shell 29 is made up, as is known, of a cylindrical cover, in which longitudinal splits 30 are made, and these are open at the front and terminate at the back with a slot 30' that is inclined at 90° in relation to the splits 30. When the tools are positioned in their relative shells 29, the radial pins 15 are level with the slots 30', so that the tools cannot be removed from the shell except after being rotated, which causes alignment of the pins 15 with the longitudinal splits 30. According to the invention, the body of each shell 29 is crossed longitudinally and level with the two slots 30' that are diametrically opposite a pair of cylindrical rods 31, each of which presents a portion 31' of reduced section, for example semi-cylindrical. The two rods 31 are connected at the back by a plate 32, which is parallel to the back wall 33 of the rack. Normally, the rods 31 are held by relative springs 34, situated between one of their heads 31" protruding, at the front, from the shell 29, and the shell itself, in a forward position where the plate 32 is detached from the back wall 33 of the rack and the reduced section portions 31' are inside the body of the shell—FIGS. 4, 4*a*. In this position, the tools cannot be rotated, since two pins 15 are locked in the relative slots 30' by the rods 31.

In order to unlock the tools, it is necessary for the tool holding clamp 18 to be inserted fully into the shells 29 until the fixed pin 20 pushes the plate 32 so that it touches the back wall 33 of the rack. Then, the reduced section portions 31' of the rods are level with the slots 30' allowing the tool pins 15 to rotate—FIGS. 5, 5*a* and 5*b*. At this point, when the button 25 on the clamp handle 19 is pressed, the magnet holder disc 22 comes into close contact with the tools, which can then be rotated and removed from the shell.

Figure 6:
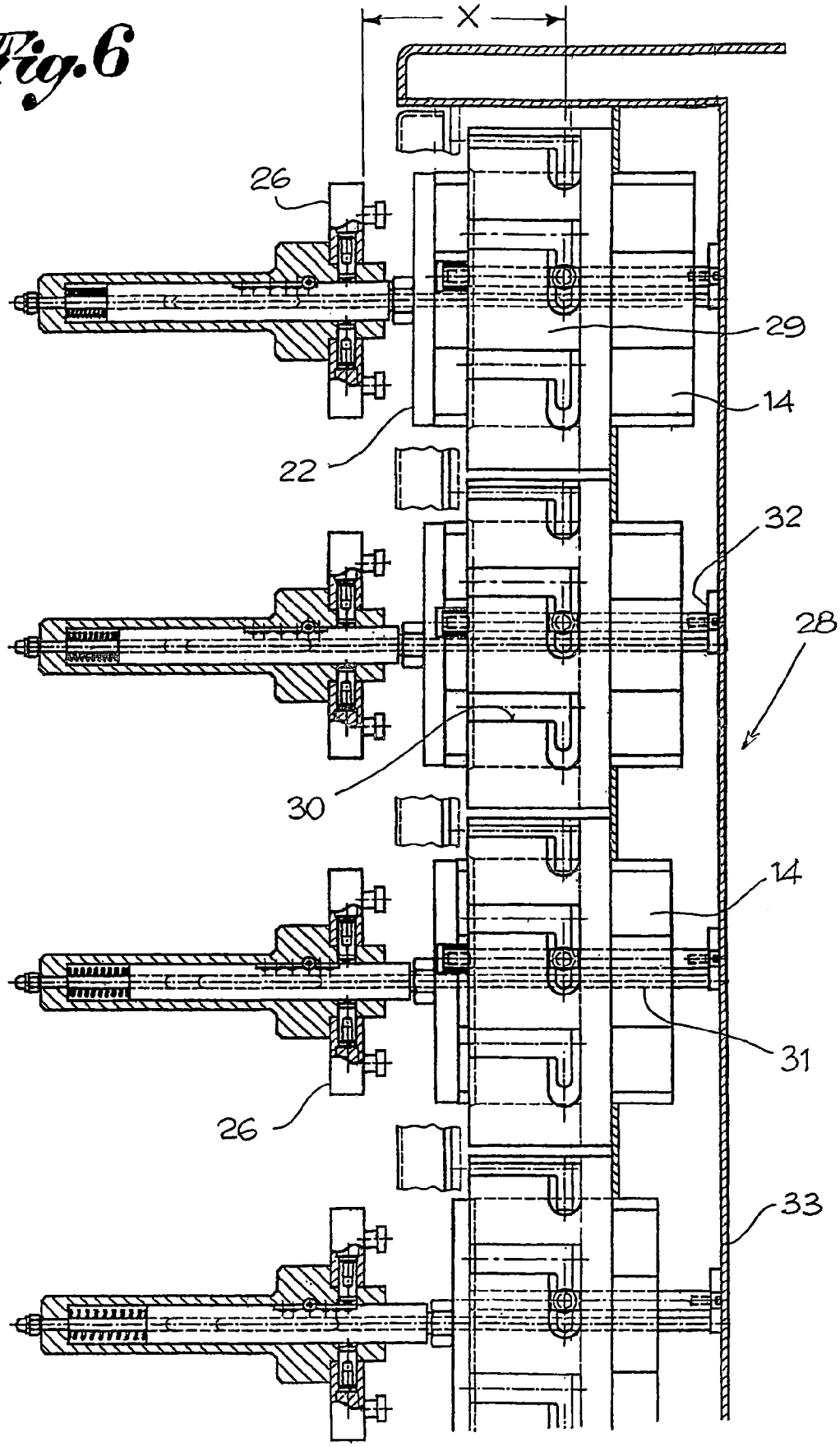
FIG. 6 shows a section of part of a tool holding rack for vertical radial presses, where a clamp is inserted into each shell for removing the tools.

As may be seen from FIG. 6, the two states of the fixed pin 20, pushed against the back wall 33 of the rack and magnet holder disc 22 touching the tools 14, guarantees that the X distance between the clamp centering plate 26 and the radial pins 15, which coincides with the distance between the front plane of the press, where the clamp, and its center is touching, is always the same regardless of the size of the tools. In this way, axial centering of the tool pins, whatever their length, is always achieved in relation to the slots 16 in the jaws.

As for angular centering, the upper block 10' of the vertical press is supplied with a pair of "U" guides 34 where the mushroom pins 27 of the centering plate 26 are to be inserted. The guides 34, therefore, determine the exact angular position of the tool holding clamp, when this is resting on the front part of the press, thus constraining this position, also when the upper block 10' is lowered towards the lower block and contributes to supporting the weight of the clamp with the tools. The guides 34 are also configured complementarily with the mushroom pins 27, so that the clamp can only be released from the guides by lifting it but not by removing it axially, thus avoiding any risk of the clamp falling forwards towards the operator. Moreover, the support of the pins 35 against the lower block of the press guarantees stability and also that the clamp always stays perpendicular to the press, contributing to making operations of tool assembly/disassembly safe and easy.

Figure 7:
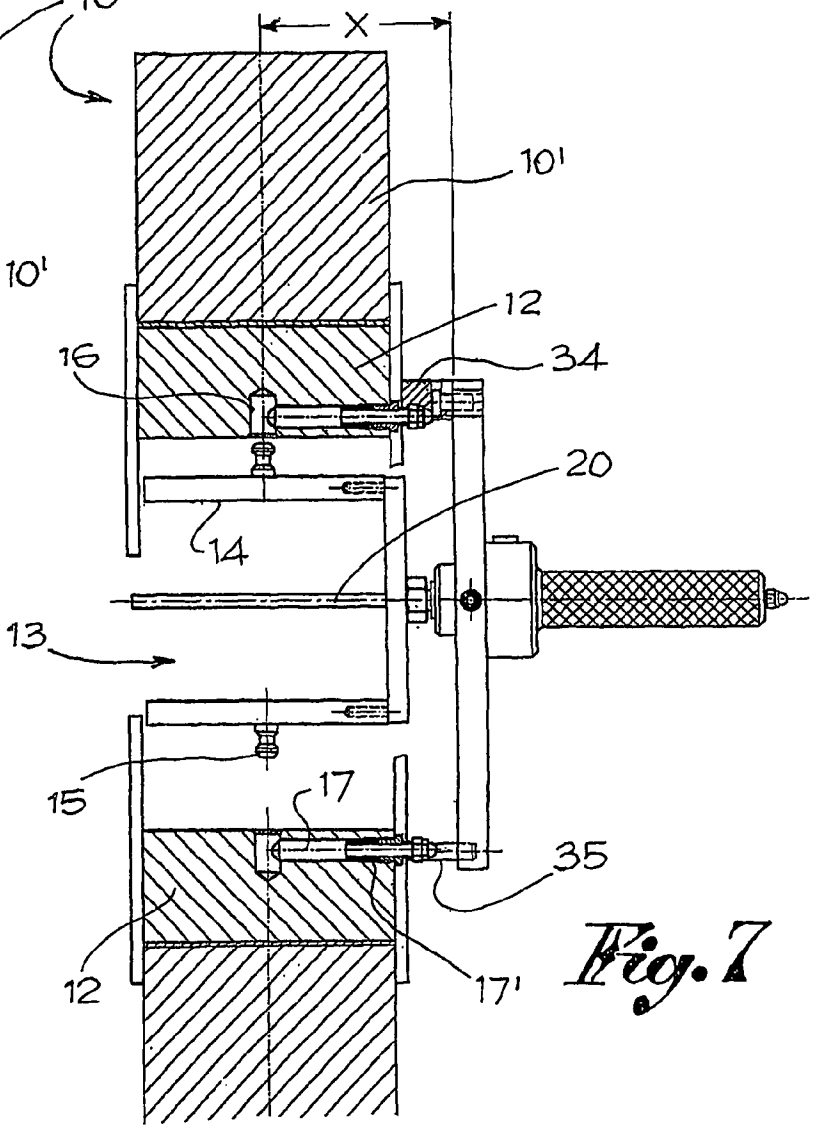
FIGS. 7 and 7*a* show an axial section and front view of the tool holding clamp during the assembly phase of the tools onto a vertical radial press.
Figure 7A:
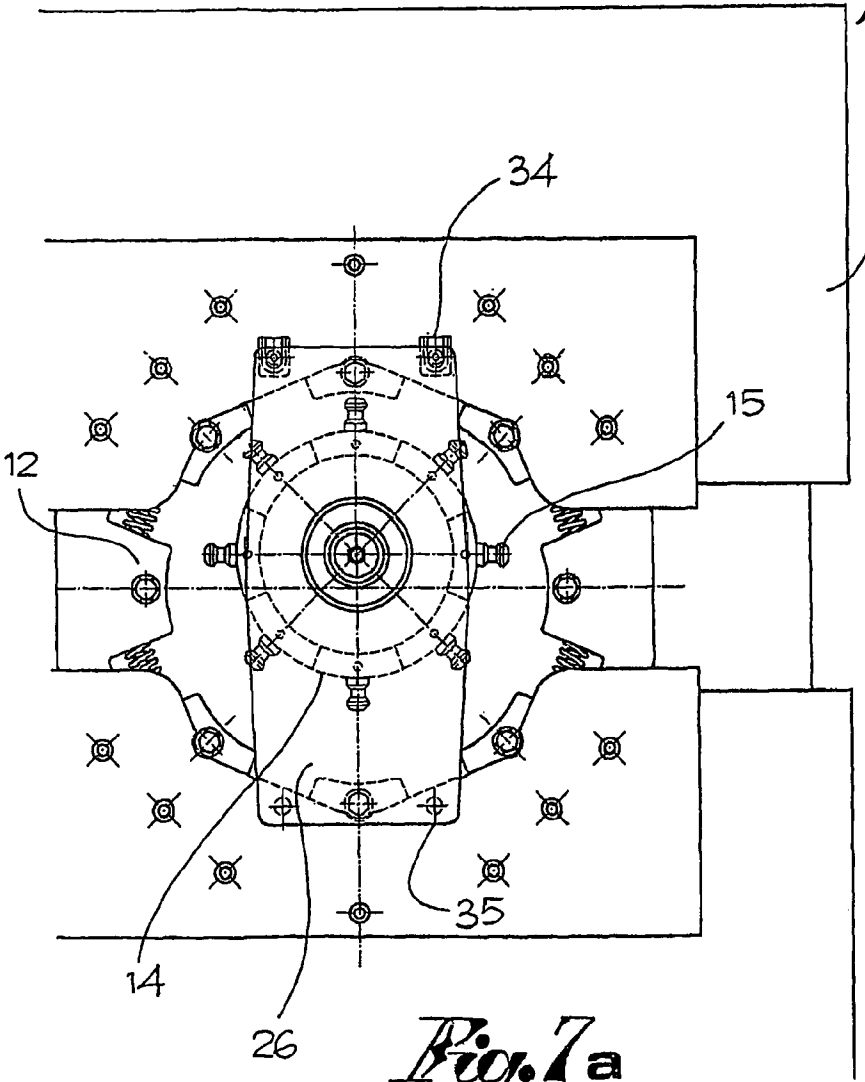
Figure 8:
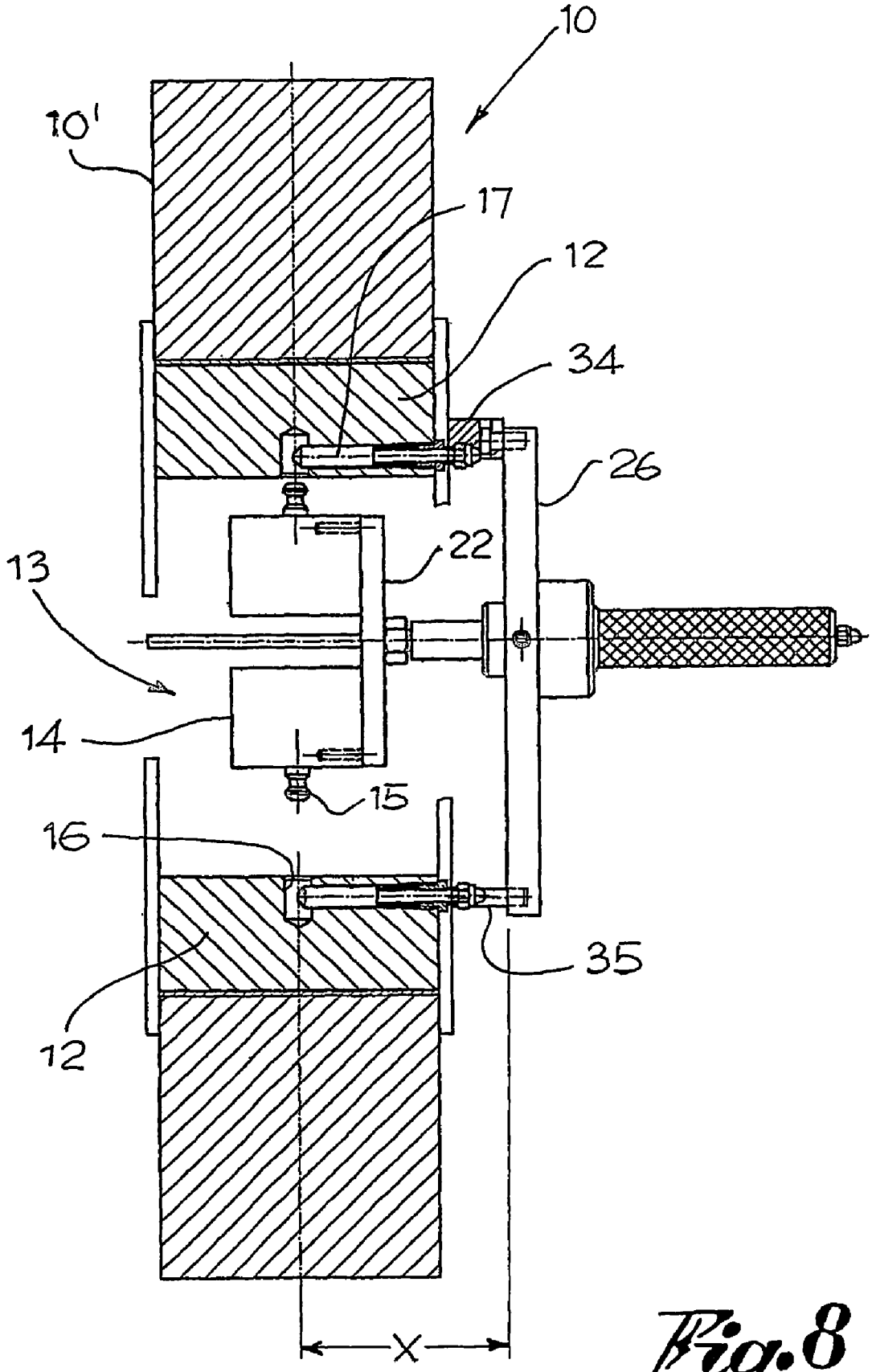
FIG. 8 shows a view similar to the one in FIG. 7, but with the clamp carrying a set of tools of differing sizes.

FIGS. 7-8 illustrate two examples of application of the tools 14 to a vertical press 10, where the tools are of differing sizes. In these Figures it is possible to observe that, in the case of longer tools, the sliding pin 21 is in a backward position, and fully contained inside the handle 19, whereas for shorter tools, the sliding pin is in a forward position, so that the X height between the centering plate and the median plane of the press, where the slots of the jaws rest, is always constant.

In the case of horizontal radial presses 11, and with reference to FIGS. 9-12, the proposed tool holding clamp 118 is provided only with the usual magnet holder disc 122 and an angular centering plate 126, which is integral at the distal end of the handle 119 and designed to rest against a front surface of the horizontal press 11, when the clamp is inserted into the central opening 13 of the press.

Figure 10:
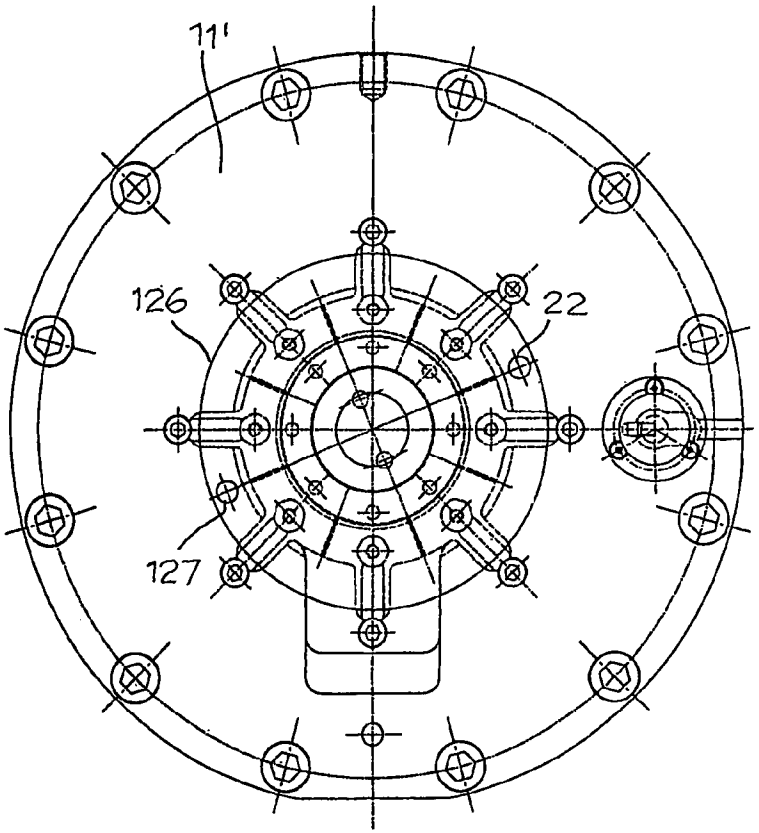
FIG. 10 shows a front view of the clamp and press in FIG. 9.
Figure 9:
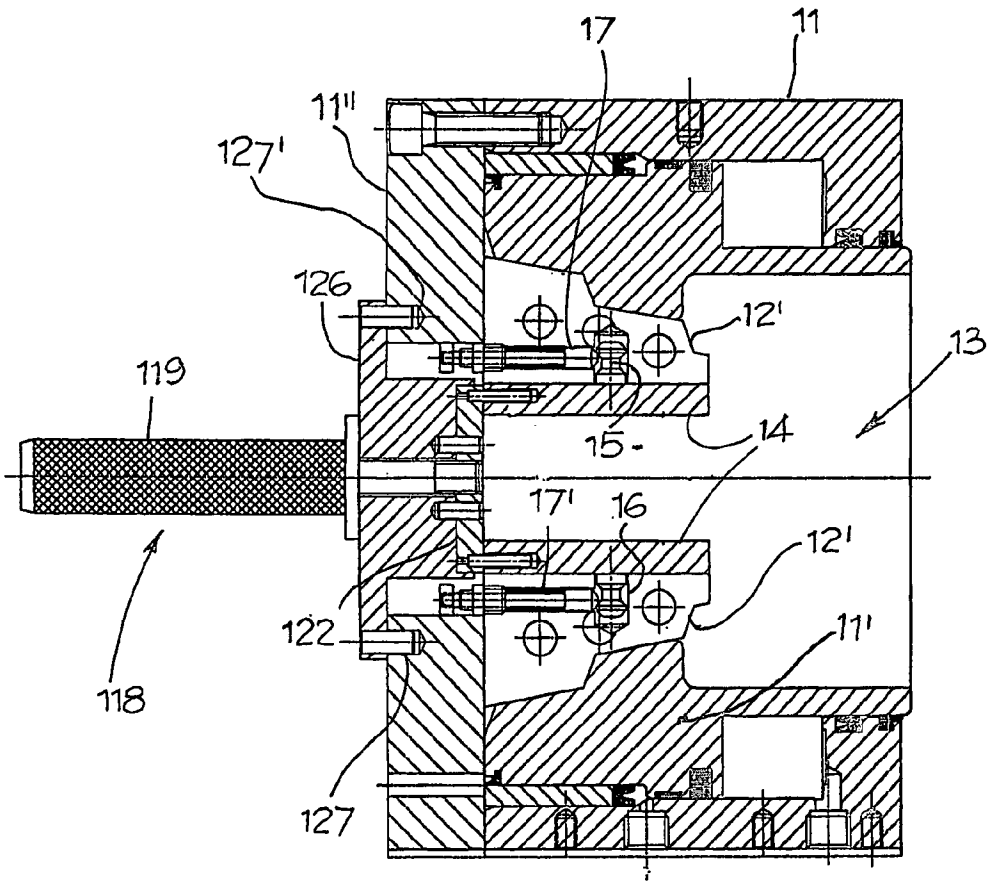
FIG. 9 shows an axial section of a tool holding clamp for horizontal radial presses inserted into one of these presses.

In particular, in a first example of embodiment illustrated in FIGS. 9 and 10, the diameter of the centering plate 126 is such as to rest against the front flange 11' of the press and is fitted with a pair of pins 127 to be inserted in corresponding holes 127' in said flange 11'.

Figure 12:
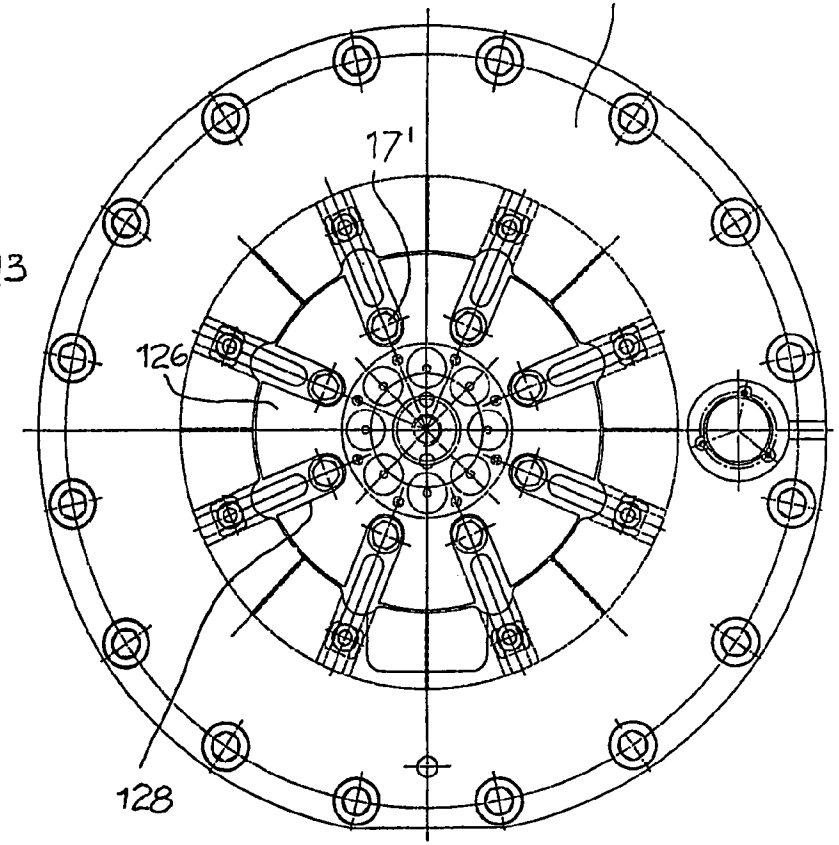
FIGS. 11 and 12 show views similar to those in FIGS. 9 and 10, but with the clamp in an alternative embodiment.
Figure 11:
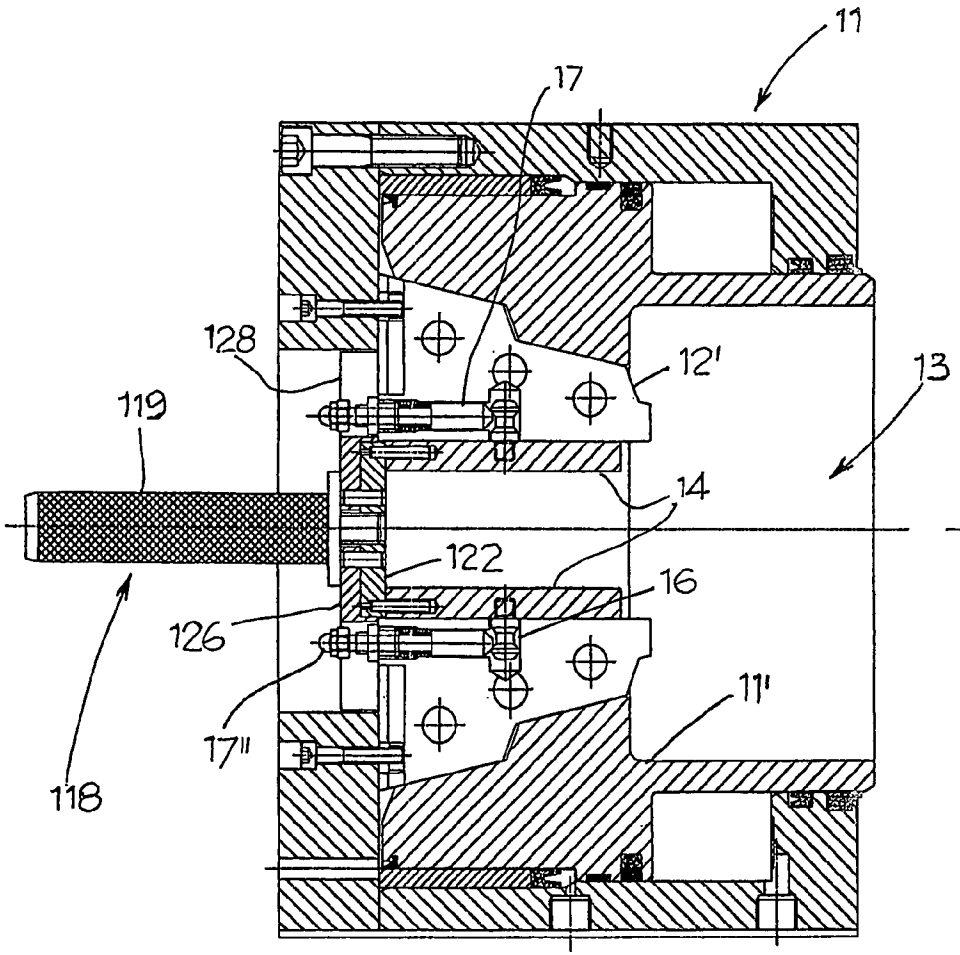

In a second embodiment, shown in FIGS. 11 and 12, the centering of the tool holding clamp exploits the front plane of the jaws 12' and the guide dowels 17" of the lock pins 17, these protruding from the front plane. For this purpose, a plurality of radial slots 128 is made in the centering plate 126. The guide dowels 17" of the lock pins 17 are inserted in the slots and are free to slide in the slots when the plate 126 is resting against the front plane of the jaws 12'.

In the case of horizontal presses, it is possible to use a normal tool holding shell, since axial centering is not required.

The invention claimed is:

1. Tool holding clamp for changing tools in a radial press having a press axis and a plurality of radial jaws arranged around the press axis onto which the tools are mounted, wherein said tools and jaws have complementary coupling means, wherein the clamp has centering devices, cooperating with the radial press to align said complementary coupling means while mounting to tools onto the jaws of the press, and further comprising an angular centering plate to be rested against a front surface of the press, said plate and said front surface presenting complementary centering devices.

2. Tool holding clamp according to claim 1, wherein said centering devices comprise at least one pin, which extends from the centering plate for insertion into a corresponding hole made in the press, or from the press for insertion into a corresponding hold in the centering plate.

3. Tool holding clamp according to claim 1, wherein each radial jaw is provided with a lock pin for locking the tool applied to it, and wherein a guide dowel is connected to said pin protruding from the jaw.

4. Tool holding clamp according to claim 3, comprising an angular centering plate where a plurality of radial slots is made, said plate being intended to rest on the front surface of the jaws so that said guide dowels of the pins are inserted and free to slide in said slots.

5. Tool holding clamp according to claim 1, where said presses comprise a mobile block, which can be moved in height in relation to a fixed block, in which at least one pair of mushroom pins and at least one pair of pins or similar components extend from the angular centering plate, the at least one pair of mushroom pins being intended to be inserted into corresponding U guides provided on the mobile block, the at least one pair of pins or similar components being intended to rest on the fixed block of the vertical press, said U guides also being configured to allow axial locking of the tool holding clamp.

6. Tool holding clamp according to claim 5, comprising a disc fixed to the distal end of a grip handle and fitted with check devices where the tools are constrained, and a fixed pin, which extends axially from said grip handle, said disc being translatable along said fixed pin and being lockable in a position determined by the length of the tools so that when the clamp is resting on the front surface of the press, said tools are always aligned axially with the jaws whatever their length is.

7. Tool holding clamp according to claim 6, wherein said disc is fixed to the distal end of a pin placed coaxially around the fixed pin and sliding on this between a backward position, where it is completely contained inside the grip handle, corresponding to the carrying of longer tools, and a forward position, corresponding to the carrying of shorter tools, passing through a plurality of intermediate positions, corresponding to the carrying of intermediate length tools.

8. Tool holding clamp according to claim 7, wherein the sliding pin is normally pushed into a forward position by a back spring located in the grip handle, and where said handle is provided with stop devices that interact with said sliding pin to lock this in a backward position and in the intermediate positions.

9. Tool holding clamp according to claim 7, wherein said stop devices comprise a small cylinder, which is set transversely in the handle and selectively engaging, stressed by a relative spring, in a plurality of transverse grooves made in the sliding pin, a button being connected to said small cylinder, which, when pressed releases it from the grooves allowing the sliding pin to slide on the fixed one.

10. Tool holding clamp according to claim 1, wherein the complementary coupling means comprises radial pins and corresponding slots.

11. Tool holding rack for holding tools for vertical radial presses having devices for positioning the tools on a tool holding clamp in a position aligned with jaws of the press, wherein:

the rack comprises a plurality of tool holding shells, each containing a set of equal sized tools for being inserted into the jaws of the press by the tool holding clamp, each tool holding shell has movable elements that interact with said clamp and permit removal of the tools only when the clamp is in a pre-set position of reference to determine positioning of the disc with check devices of the tools along the fixed pin depending on the length of the tools contained within the shell, each tool holding shell comprises a cylindrical body with longitudinal splits, which are open at the front and terminate at the back with a slot that is inclined at 90° in relation to said splits, and each tool is provided with a radial pin that engages normally in said slot, sliding in a corresponding longitudinal split to remove the tools from the shell after rotation, which sliding is controlled by the tool holding clamp, and the body of each shell is crossed longitudinally by at least two diametrically opposed cylindrical rods passing through respective slots, said rods being connected at the back by a plate, which is parallel to a back wall of the rack, and being movable axially between a forward position for locking the radial pins in said slots, and so also the tools in the shell, and a backward unlocking position of said pins, said rods being normally held in a forward locking position by respective springs and being movable to the backward unlocking position after a thrust by said plate against the back wall of the rack by the fixed pin on the clamp.

12. Tool holding rack for vertical radial presses according to claim 11, wherein each rod presents a section which is sized to interfere with the radial pins and a portion of reduced section, which allows said pins to pass under the rods, said portion of reduced section being level with the slots in the body of the shell only when the rods are in the backward position.

13. Radial press, particularly, but not exclusively, for connecting flexible tubes, comprising a plurality of radial jaws onto which respective pressing tools are mounted, wherein the tools and jaws are provided with complementary coupling means, such as radial pins and relative slots, further comprising a tool holding clamp onto which the tools are mounted, wherein said tools and jaws have complementary coupling means, wherein the clamp has centering devices, cooperating with the radial press to align said complementary coupling means while mounting to tools onto the jaws of the press, and further comprising an angular centering plate to be rested against a front surface of the press, said plate and said front surface presenting complementary centering devices to guarantee alignment of said complementary devices when the tools are mounted onto the jaws.

* * * * *